United States Patent [19]

Irwin

[11] Patent Number: 4,781,373

[45] Date of Patent: Nov. 1, 1988

[54] LEG STRETCHING APPARATUS

[76] Inventor: Charles F. Irwin, 1310 Fleming Ave., Lot A-1, Ormond Beach, Fla. 32074

[21] Appl. No.: 898,922

[22] Filed: Aug. 21, 1986

[51] Int. Cl.[4] ..... A63B 21/00

[52] U.S. Cl. ..... 272/126; 272/903

[58] Field of Search ..... 272/93, 125, 126, 134, 272/145, 144, 146, 903

[56] References Cited

U.S. PATENT DOCUMENTS

| | | | |
|---|---|---|---|
| 4,139,193 | 2/1979 | Felber et al. | 272/146 |
| 4,185,818 | 1/1980 | Brentham | 272/134 X |
| 4,445,684 | 5/1984 | Ruff | 272/134 |
| 4,456,247 | 6/1984 | Ehrenfried | 272/126 |

OTHER PUBLICATIONS

Black Belt, 7/1985, p. 109, Leg Stretcher.

*Primary Examiner*—Richard J. Apley
*Assistant Examiner*—J. Welsh

[57] ABSTRACT

Disclosed is a base, consisting of two identical plates, with a handle attached in the middle by two bolts to stabilize the base. Two extension assemblies consisting of two round tubes, one inside the other, are attached to each end of the base by one bolt each. The inner tubes have holes drilled one inch apart for adjusting the length by moving a pin either in one side or the other. The inner tubes telescope and can turn 360 degrees. This allows the handle to be pulled toward the operator and raised to a perpendicular position, to hold the apparatus at any adjustment level, in the fully extended position. Each adjustment level moves the legs apart by one inch at a time, after reaching the desired starting position. Attached to the outer ends of the adjustment tubes, are "U" shaped stirrups, on an angle, so they rest against the ankles and not cause any extreme pressure against the tops of the feet, when in the fully extended position. The apparatus can be controlled with only a pressure from one hand while in the "HOLD" position. Other stretching exercises can be done for the back and side muscles, as well as for the legs, while in this position.

1 Claim, 3 Drawing Sheets

LEG STRETCHING APPARATUS

BACKGROUND OF THE INVENTION

This invention relates to exercises and stretching devices, and particularly to leg stretching devices. Muscle strength is important. Of equal, and often overlooked importance, is the maintenance and, or increase of flexibility. In some sports, flexibility is an absolute must. In all sports flexibility is desired. Building muscles shorten them. Inflexible muscles detract from performance flow, as counteracting muscle must fight against the extension resistance of others. This phenomenon limits your effectiveness by robbing stamina and endurance, while more apparent limitations surface from the shortened and restricted movements of your athletic objectives.

The prior art includes various patents pertaining to exercise devices and stretching devices.

U.S. Pat. No. 3,109,646 to H. Klein pertains to a stretching device for ballet dancer to develope a reasonable "turnout". This is the degree to which a dancer can rotate, or turn his legs outward from the respective hip joints. This device is limited mostly to only stretching the legs for the object of attaining the "turnout".

U.S. Pat. No. 4,125,258 to McArthur is an apparatus for exercising the limbs to build muscles, which actually shortens the muscles.

U.S. Pat. No. 4,277,062 to Lawrence discloses a leg stretching exercising device, comprising a platform attached to a bar with pulley's attached to each end. Each pulley contains a rope with foot stirrup at one end for locking one's foot and a handle at the other end. The handles are pulled, stretching one's legs which are placed in the stirrups.

U.S. Pat. No. 4,456,247 to Ehrenfried discloses two seperate leg supporting members, which are independently pivotablly connected to a base assembly. At their pivotal connection with the base assembly, they are further provided with a disk assembly, having a cable attached thereto. The cable from each leg supporting member is attached through guide means to a crank assembly, which during operation forces the leg supporting members apart, stretching the legs of the user of the device into a 'split' position. The crank assembly housing is piviotally mounted, such that, when the housing is moved forward and/or rearward, the cable path of both cables is lengthend a small amount, providing the user with a controlled minute additional stretching movement. The unit can be folded up to a fairly compact storage configuration.

SUMMARY OF THE INVENTION

It's the object of this invention to provide a simple, inexpensive, new and improved leg stretching device, without the use of a platform, seat, pulley's, ropes, cables, winch, crank or gears. A device to be utilized by people of different sizes, that has "minute" controlled adjustment levels, to obtain and "Hold" at each adjustment level, for the purpose of reaching a side leg split up to 180 degrees, and for any place in between for desired flexibilty. It's small, light weight, portable, and easy to use.

Another object is that the operator can release the total tension on the muscles, ligaments, and tendons, within a fraction of a second, at the first sign of a muscle cramp, or before a muscle, ligament, or tendon tears. The operator controlls the amount of force applied and can lock the apparatus at many adjustment lengths. You can sit on your own livingroom floor and be stretching while you watch T.V., or read a book.

It's a proven fact, that a person with properly stretched muscles, will have less chance of being injured, and increase his or her performance.

BRIEF DESCRIPTION OF THE DRAWINGS

This invention is a simple and easy to use apparatus for stretching the muscles, ligaments, and tendons, in a "Split" position, while in a sitting position. Other objects and advantages may be seen from the following description when viewed in conjunction with the accompanying drawings wherein.

DETAILED DESCRIPTION OF THE INVENTION

Figure 1:
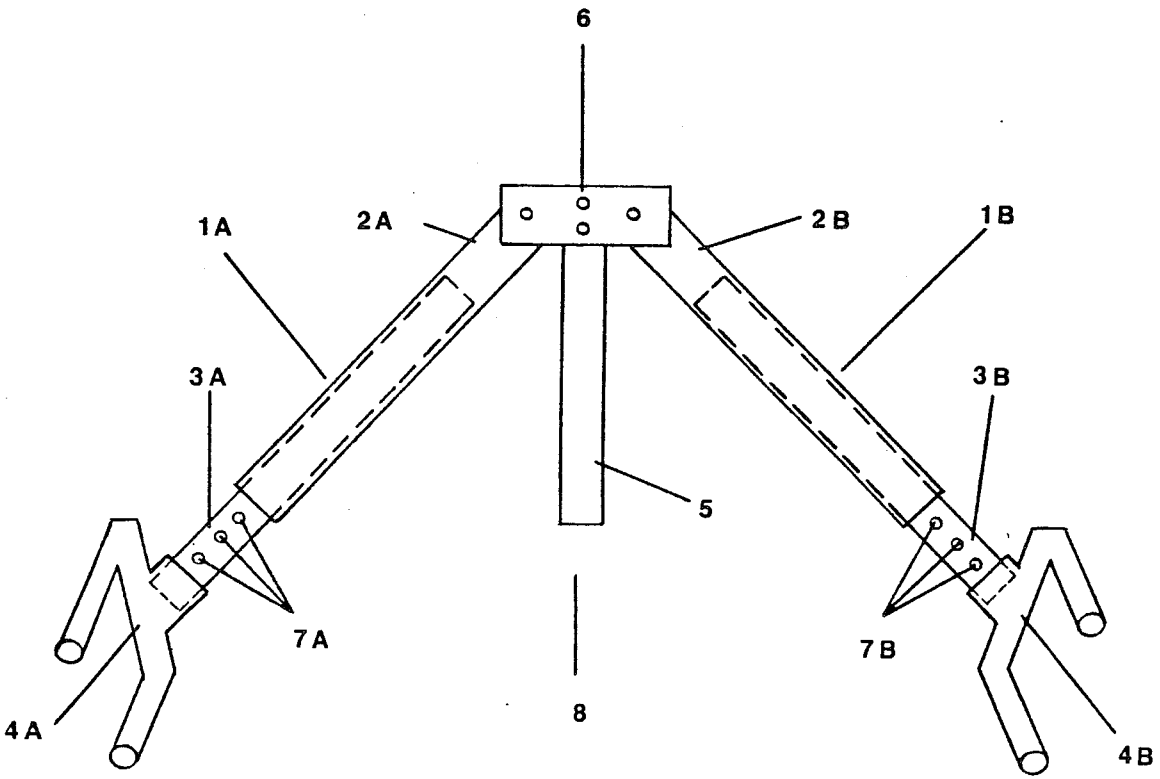
FIG. 1 is a perspective view of the leg stretching apparatus.

Referring to FIG. 1 of the drawings is a perspective view of how the leg stretching apparatus #8 would be laid out in front of the operator, in a sitting position, wherein the handle #5 is attached to the base #6 in the middle by two bolts, to stabilize and control the base. The base #6 consists of two identical plates, with two holes in the middle and one at either end. The extension assembly #1A consist of tubes #2A and #3A, and #1B consist of tubes #2B and #3B. Tubes #2A and #2B are attached at each end of the base, by one bolt each, allowing them to pivot on a horizontal plane. Tubes #3A and #3B fit inside of tubes #2A and #2B respectively, allowing them to extend or telescope from within, and allow them to turn 360 degrees. Holes #'s 7A and 7B are drilled one inch apart in #3A and #3B whereas a removeable PIN #9, can be inserted for adjusting the length. "U" shaped ankle stirrups #4A and #4B are attached on the ends of tubes #3A and #3B at an angle, so as not to cause any extreme pressure on the top of the feet, when in the fully extended position.

Figure 2:
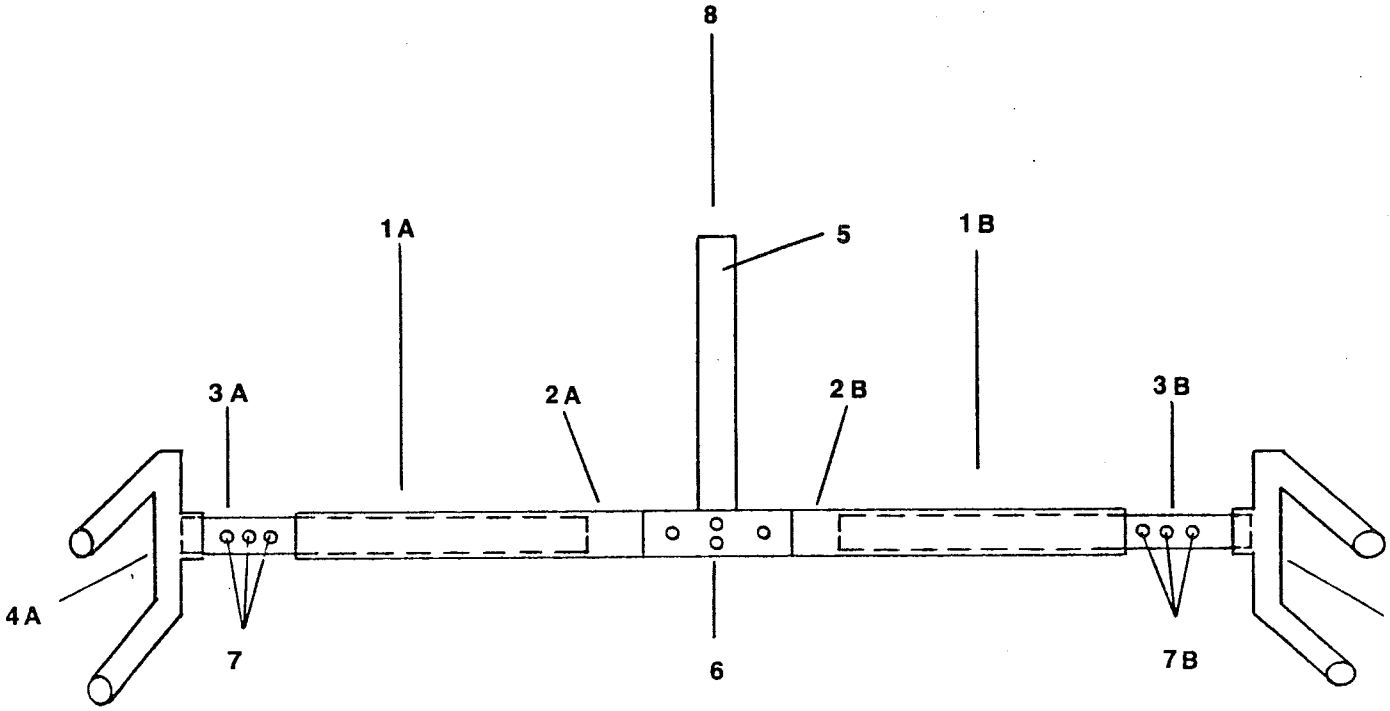
FIG. 2 is a perspective view of the apparatus in the extended position.

FIG. 2 shows a perspective view of the apparatus #8 with the handle #5 in the vertical or perpendicular position, which allowes the operator to hold the apparatus in the extended position, with only a little pressure from one hand.

Figure 3:
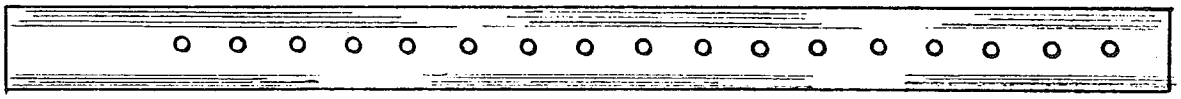
FIG. 3 is a view of parts #3A and #3B.

FIG. 3 shows tubes #3A or #3B with the adjustment holes #'s 7A or 7B, that allow for a wide range of adjustment.

Figure 4:
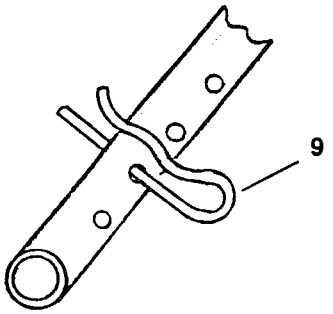
FIG. 4 is an enlarged view of the method of adjustment.

FIG. 4 shows a section of #'s 3A or 3B, with the adjustment pin #9 that makes the adjustments.

Figure 5:
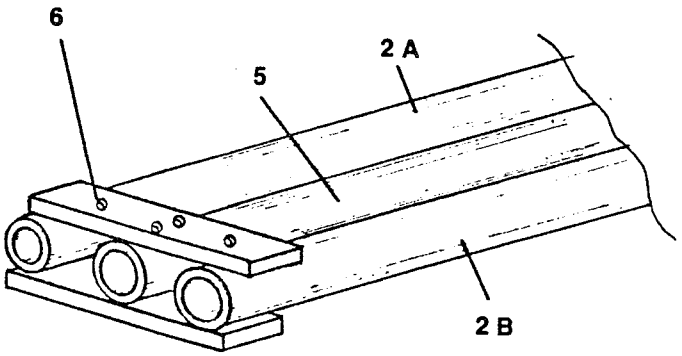
FIG. 5 is an enlarged view of the base assembly.

FIG. 5 shows the base #6, consisting of two identical plates, and how tubes #2A, 2B, and the handle #5 are attached.

It is understood that the above described arrangements are merely illustrative examples of the application. Other arrangements may be readily devised by those skilled in the art which will embody the principals of the invention, and fall within the spirit and scope thereof.

I claim:

1. A leg stretching apparatus comprising:

a base consisting of two identical plates;

a handle rigidly connectedto and between said base plates;

a pair of extension assemblies one each pivotally mounted to and between said base plates and on opposite sides of said handle;

each said extension assembly comprising two tubes, a first tube mounted at one of its ends to said base and a second tube having one end telescopic with the other end of said first tube and a second end including a U-shaped stirrup for engaging a user's ankle; and said second tube including a means to adjust the length of said extension assembly by limiting telescopic movement of said second tube with said first tube while allowing the second tube to rotate 360 degrees when in use.

* * * * *